United States Patent [19]

Marino

[11] 4,332,213

[45] Jun. 1, 1982

[54] WORKPIECE COATING APPARATUS

[75] Inventor: Frank C. Marino, Newington, Conn.

[73] Assignee: Loctite Corporation, Newington, Conn.

[21] Appl. No.: 173,204

[22] Filed: Jul. 28, 1980

[51] Int. Cl.[3] ..... B05C 1/02

[52] U.S. Cl. ..... 118/211; 118/219; 118/222; 118/225; 118/242

[58] Field of Search ..... 118/218, 221, 219, 222, 118/267, 242, 232, 211, 225

[56] References Cited

U.S. PATENT DOCUMENTS

| | | | |
|---|---|---|---|
| 1,828,855 | 10/1931 | Bourn | 118/232 X |
| 2,588,548 | 3/1952 | Markes . | |
| 2,599,561 | 6/1952 | Knight . | |
| 2,644,975 | 7/1953 | Verba | 118/218 X |
| 2,770,211 | 11/1956 | Gustafson . | |
| 2,791,983 | 5/1957 | Driskell | 118/219 |
| 2,827,012 | 3/1958 | Kesling . | |
| 2,828,715 | 4/1958 | Heyman et al. | 118/267 X |
| 2,943,378 | 7/1960 | Harkenrider et al. . | |
| 3,034,477 | 5/1962 | Williams . | |
| 3,976,029 | 8/1976 | Rosner . | |

*Primary Examiner*—John P. McIntosh
*Attorney, Agent, or Firm*—Watson, Cole, Grindle & Watson

[57] ABSTRACT

An apparatus for coating a surface of a workpiece includes at least one upstanding wick applicator, a liquid supply for wetting a tip end of the wick, a spindle mounted for rotation relative to the applicator about a central axis of the spindle, and a workpiece support on the spindle for bearing the workpiece surface against the wick tip and for effecting rotation of the workpiece together with the spindle. A plurality of wick applicators may be provided with the spindle be mounted for rotation relative to each applicator which may be at predetermined radial distances from the spindle axis.

5 Claims, 7 Drawing Figures

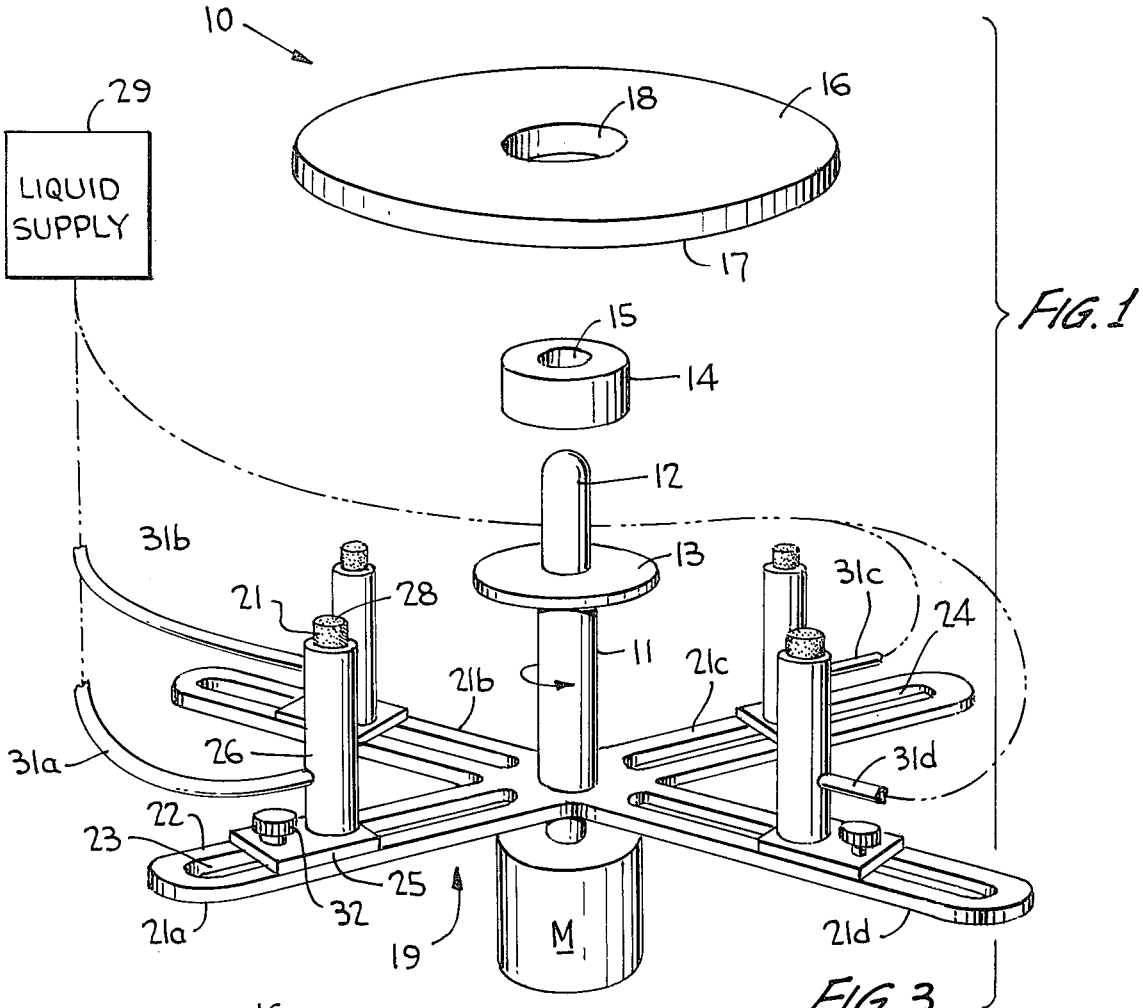
FIG. 1
FIG. 3
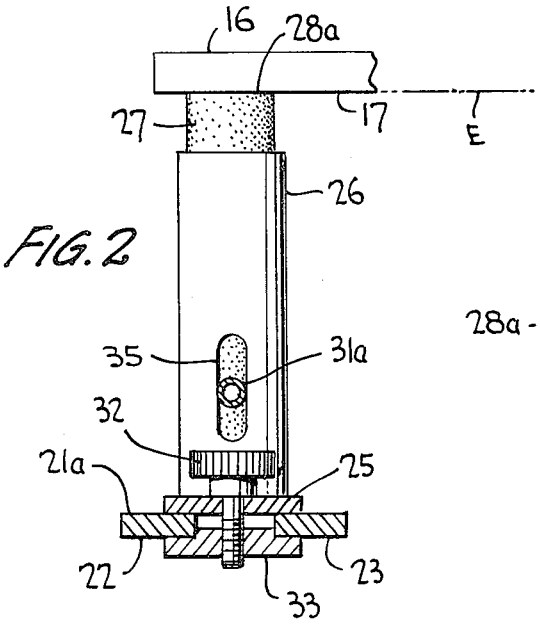
FIG. 2
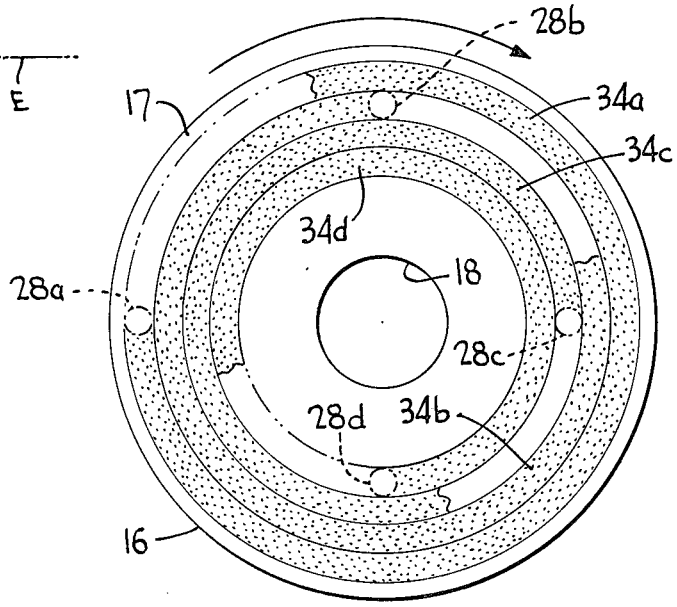

WORKPIECE COATING APPARATUS

BACKGROUND OF THE INVENTION

This invention relates generally to a coating apparatus, and more particularly to such an apparatus for coating a liquid on to a surface of a rotating workpiece using at least one stationary wick applicator.

Ferrofluids, viscous magnetic damping materials, are used in loudspeaker applications in the gap area between voice coil and polepiece of a driver assembly. Contamination upon contact with primer or adhesive in this area can cause coagulation, separation, thinning or thickening of the ferrofluid which will cause speaker failure. During the loudspeaker assembly operation, the speaker magnets are normally bonded into place by an adhesive which must avoid any loosening or dislodgement of the magnet during handling or in the presence of heat. Adhesive of the uncured variety may be used, together with a selected primer or activator, but are found incompatible with ferrofluids. Extreme care must thus be exercised in coating the primer on the magnetic disc to avoid any contact with the ferrofluids in the region of the central opening of the disc, which may cause coagulation or separation of the ferrofluid.

Speaker magnets are typically assembled by painting, spraying or dipping the magnets with the selected primer. Because of its low viscosity relative to the adhesive which is applied to a mating part, any operator error of over or under priming will affect speaker quality and even failure. These techniques are imprecise since they are carried out by hand and leave the amount of primer applied up to the discretion of the operator. They may also have dermititus problems during skin contact with the primer, and may result in disc chipping during handling of the ferrite magnet made of a low density ceramic.

SUMMARY OF THE INVENTION

It is therefore an object of the present invention to provide an apparatus, for applying a liquid to the surface of a workpiece in a controlled and precise manner with a selected liquid, which is safe and easy to operate, of simple construction and economical yet highly efficient.

Another object is to provide such an apparatus wherein the liquid is applied by a wick or felt to the underside of the workpiece, which may be a circular or differently shaped disc mounted on a rotatable spindle for rotation therewith relative to the wick.

A further object of this invention is to provide such an apparatus wherein the wick is mounted on a support extending radially outwardly of the spindle at selected distances therefrom to accommodate the coating of differently sized workpieces during rotation.

A still further object of the invention is to provide such an apparatus wherein the wick applicator is mounted on the radially extending from movement therealong toward and away from the spindle upon spindle rotation.

A still further object is to provide such an apparatus wherein the wick applicator is capable of being tilted relative to the spindle for accommodating the coating of differently shaped workpieces.

A still further object of this invention is to provide such an apparatus wherein a plurality of wick applicators may be provided at different distances from the spindle for coating the workpiece along different paths during its rotation.

Further objects, advantages and novel features of the invention will become more apparent from the following detailed description of the invention when taken in conjunction with the accompanying drawings.

BRIEF DESCRIPTION OF THE DRAWINGS

FIG. 1 is an exploded perspective view of one embodiment of an apparatus according to the invention;

FIG. 2 is a side elevational view of a typical wick applicator of FIG. 1, at a slightly enlarged scale, showing the tip end thereof relative to the undersurface of the disc workpiece to be coated;

FIG. 3 is a plan view of the disc workpiece after being coated by each of the wick applicators;

DETAILED DESCRIPTION OF THE INVENTION

Figure 4:
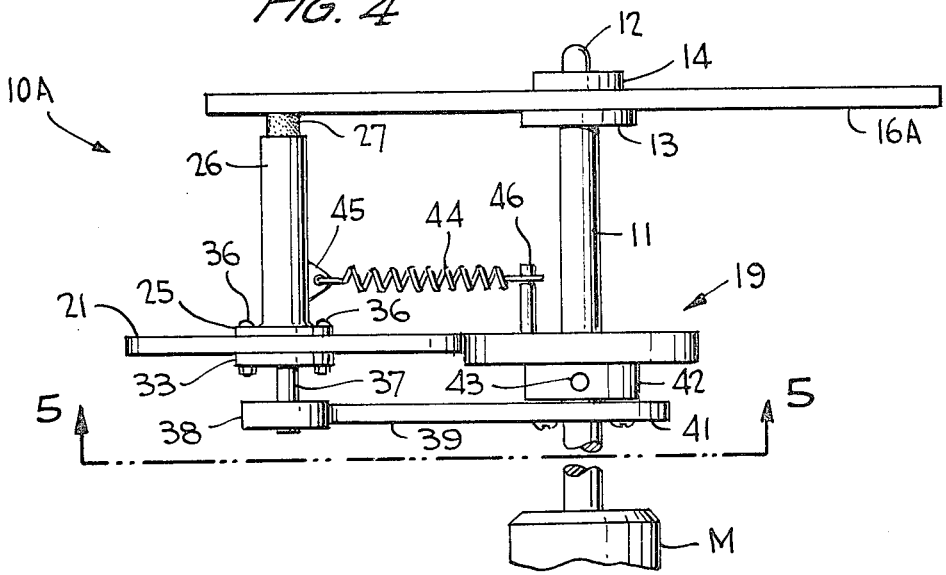
FIG. 4 is a side elevational view of another embodiment of an apparatus according to the invention.

Turning now to the drawings wherein like reference characters refer to like and corresponding parts throughout the several views, the workpiece coating apparatus, generally designated 10, is shown in FIG. 1 as including a spindle 11 capable of being rotated in either a clockwise or counterclockwise direction about its central longitudinal axis by a motor M. An upper portion 12 of the spindle has a smaller diameter than the remainder thereof so as to define an annular shoulder (not shown) on which a washer 13 or the like rests. The washer is secured in any normal manner to the spindle, as by a press fit, for rotation therewith. A bushing 14 is inserted over upper portion 12 so that its lower surface comes to rest on the upper surface of the washer. The diameter of central opening 15 of the bushing may be substantially the same as the diameter of upper portion 12, so as to produce an interference fit therewith. Otherwise, the bushing may be of a ferrous material and washer 13 may be of a magnetic or non-slip material to facilitate rotation of the bushing together with the spindle without slipping.

A workpiece 16, to be coated along its undersurface 17, may have a central opening 18 of a diameter substantially equal to the outer diameter of bushing 14 so as to provide a slip fit therewith when seated thereover and against washer 13 to facilitate rotation of the workpiece together with the spindle without slipping. Otherwise, workpiece 16 may be a ferrite magnet disc used in loudspeaker assemblies and held against slipping by magnetic attraction with magnetic washer 13. Although workpiece 16 is shown in FIG. 1 as a circular disc, it may comprise a non-circular disc, a dish-shaped disc, a disc having an irregular undersurface, etc., to be coated along its surface 17 with a specific type liquid. And, bushing 14 may be interchangeable with bushings having the same control opening 15 diameter but having various outer diameters for accommodating various size workpieces to be coated.

A stationary support member 19 is mounted in any normal manner within the apparatus at the base of the spindle and extends radially outwardly thereof in a plane perpendicular to the spindle axis. Member 19 includes a plurality of support tracks 21*a*, 21*b*, 21*c*, and 21*d*, there being four of such tracks illustrated in FIG. 1 although only one track 21 need be provided and the provision of more than four tracks are possible without departing from the spirit of the invention. Each track 21 extends outwardly of the spindle axis a sufficient distance for accommodating the coating of the largest size workpiece 16 to be coated. And, each support track may comprise a pair of spaced parallel legs 22, 23 defining a radially extending groove 24 therebetween. A base plate 25 is seated on the support track and spans groove 24, as more clearly shown in FIG. 2. A jacket or cylindrical cover 26 is mounted at its lower end to the base plate and extends upwardly parallel to the spindle. An elongated cylindrical wick or felt member 27 is encased by the jacket and terminates outwardly of the upper end thereof in a tip end 28. A liquid supply in a container 29 of some type includes a hose 31 for gravity feeding the liquid to be coated to wick 27 near the bottom end thereof. The hose extends through jacket 26 for feeding the liquid directly to the wick so that the liquid will rise by capillary action until the entirety of the wick, including is saturated and wetted with the liquid to be coated. The wick applicator is capable of being manually positioned along its support track at different distances from the spindle, and may be clamped in a desired position therealong by means of a turnscrew 32 which threadedly engages with a clamping plate 33 (FIG. 2) seated against the underside of legs 22, 23 and spanning of the groove therebetween.

Each of the four wick applicators illustrated in FIG. 1 are constructed in the identical manner as described above, and hoses 31*a*, 31*b*, 31*c* and 31*d* interconnect the liquid supply with the interior of each of the applicator jackets for feeding the liquid to be coated by gravity from the supply to each of the wicks for constantly wetting the tip ends thereof by capillary action.

The tip ends 28*a*, 28*b*, 28*c* and 28*d* of the four wick applicators each lie at the same elevation E as undersurface 17 of the disc, as typically shown in FIG. 2. In operation, a disc 16 to be coated is placed over bushing 14 until it seats on washer 13, and depending on the size of the disc to be coated, one or more wick applicators are moved toward the spindle axis to underlie the surface 17. Since the tip ends lie at the same elevation as surface 17, the wick applicator or applicators contact the undersurface at their tip ends. If all four wick applicators are to be utilized, they may be spaced different distances from the spindle for traversing different and contiguous circular paths 34*a*, 34*b*, 34*c* and 34*d* as shown in FIG. 3, along surface 17 during rotation of the disc together with the spindle. Turnscrew 32 on each wick applicator is manually operated to clamp the applicators into their desired positions. Otherwise, the four applicators may be set relative to the spindle at selected distances for traversing non-contiguous paths of coating depending on the particular application and/or disc size involved. Of course, three, two or only one of the wick applicators may be utilized for the coating operation. Since support member 19 is stationary, the spindle together with the disc rotates about a central axis of the spindle relative thereto and sweeps a path or paths of coating material on to its undersurface 17 as it contacts one or more of the wetted tip ends of the wick or wicks.

As pointed out above, apparatus 10 according to the invention is capable of coating the undersurface of a workpiece 16 which may be a circular disc as shown, or may be a non-circular disc, such as square, oval etc., or may be dish-shaped or may have an irregular undersurface to be coated. For each such workpiece its undersurface will be coated along a circular path by the wick applicator. Should the workpiece to be coated have an irregular undersurface, as for example, with depressions and/or protrusions thereon, it may be advantageous to be able to shift wick 27 outwardly or inwardly relative to its jacket 26 to accommodate such depressions and/or protrusions. Thus, hose 31 may be imbedded in the wick and may extend through a vertically enlongated slot 35 provided in the jacket, as shown in FIG. 2. The hose may thus be manually grasped and moved upwardly or downwardly along the slot for thereby shifting the tip end of the wick further outwardly or inwardly of the jacket.

Figure 5:
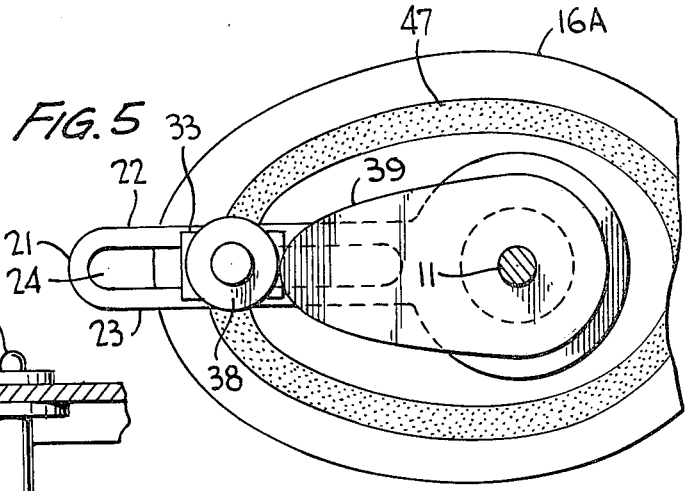
FIG. 5 is view taken substantially along line 5—5 of FIG. 4.

Another embodiment of the coating apparatus according to the invention, generally designated 10A, is shown in FIG. 4 and is similar in many respects to apparatus 10 so that like parts will be identified by like reference numerals. Apparatus 10A makes provision for movement of the wick applicator along its track toward and away from spindle 11 upon spindle rotation. The wick applicator is mounted on support rack 21 similarly as described with reference to FIG. 1 except that turn screw 32 is eliminated and the wick applicator is mounted for sliding movement along the track without interference. For example, plates 25 and 33 may be interconnected by bolts 36 extending therethrough so as to loosely clamp the plates onto track 21. A stud 37 depends from plate 33 and has a follower roller 38 mounted for free rotation at the lower end thereof. A cam element 39 is fastened as at 41 to a collar 42 which is connected to the spindle by means of a fastener 43 to facilitate rotation of the cam element together with the spindle. As shown in FIGS. 4 and 5, the cam follower bears against the peripheral edge of the cam and is maintained in such a bearing relationship with the cam by means of a tension spring 44 (FIG. 4) connected at one end to jacket 26 as at 45 and connected at its opposite end to an inner portion of support 21 by means of a pin 46 mounted on the support. Thus, rotation of the spindle together with cam element 39 moves the wick applicator along its track for traversing a path 47 corresponding to the shape of the cam. Thus, if workpiece 16A is of an oval shape similar to that of the cam and mounted eccentrically on the spindle, oval path 47 will be spaced uniformally from the edge of the workpiece. Otherwise, the workpiece may circular or of some other shape and its undersurface will be coated along an oval path when desired to meet some specific coating or other requirement.

Figure 6:
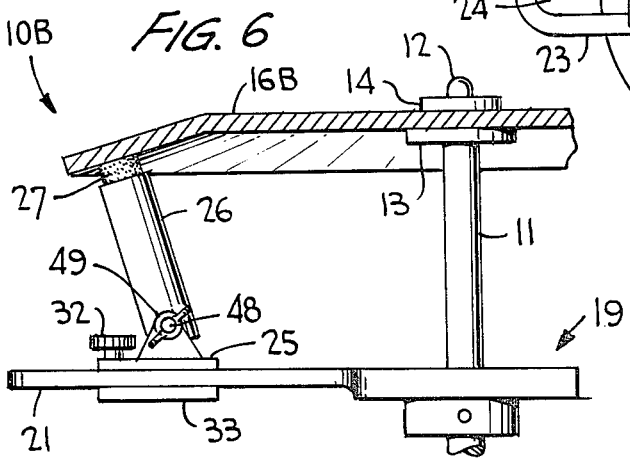
FIG. 6 is a side elevational view of still another embodiment of an apparatus according to the invention showing the wick applicator tilted in one direction relative to the spindle.
Figure 7:
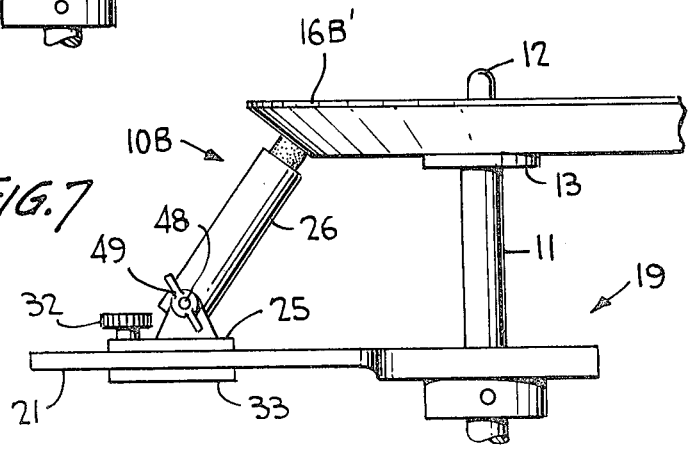
FIG. 7 is a view similar to FIG. 6 showing the wick applicator tilted in another direction relative to the spindle.

Another apparatus is shown in FIGS. 6 and 7, generally designated 10B, which is the same as apparatus 10 except that the wick applicator is capable of being tilted at its base relative to the central longitudinal axis of the spindle. Thus, jacket 26 is mounted at its base for tilting movement about a transversely extending pin 48, and may be maintained in the tilted positions of either FIGS. 6 and 7 by the manual tightening of a thumb screw 49 or the like. Thus, the curved or slanted undersurface of dish-shaped or concave disk 16B may be coated using apparatus 10B by simply tilting the applicator away from the spindle as shown in FIG. 6. And, if the workpiece such as 16B' has an undersurface to be coated which slants upwardly or which is convex, the wick applicator may be tilted toward the spindle as shown in FIG. 7 to effect a coating of such surface.

It should be pointed out that coating apparatuses 10A and 10B are described with reference to a single wick applicator, although support member 19 may have more than one support track for supporting more than one wick applicator such as described for apparatus 10. Apparatus 10A would thus include more than one wick applicator and cam for widening the coated path when desired. And, apparatus 10B would include more than one tiltable wick applicator for likewise widening the coated path.

From the foregoing it can be seen that a simple and economical yet highly effective coating apparatus has been devised for the coating of a liquid on to the surface of a workpiece in a highly controlled and precise manner so as to avoid operator error of over or undercoating the workpiece and substantially avoiding operator contact with the coating material. When selected activators are to be coated on surface 17 during a speaker magnet assembly operation, for example, such coating materials avoid contact and the accompanying incompatability problems otherwise found with ferrofluids used in loudspeaker applications. And, the apparatus according to the invention is capable of not only effectively coating circular disc workpieces, but other workpieces of various shapes.

Obviously, many modifications and variations of the present invention are made possible in the light of the above teachings. For example, the wick may be rectangular in cross-section with its jacket mounted for shifting about its central axis for disposing the long side or short side of the tip end against surface 17 for changing the width of the coated path. It is therefore to be understood that within the scope of the appended claims the invention may be practiced otherwise than as specifically described.

What is claimed is:

1. An apparatus for applying a liquid coating along at least one predetermined path to the surface of a workpiece, comprising a spindle rotatable about a central axis thereof for supporting and rotating the workpiece to be coated, a stationary support member mounted on said spindle and lying perpendicular to said central axis, said support member including at least one track element extending radially outwardly of said axis, at least one wick jacket mounted on said track element at a distance from said spindle for describing said predetermined path, a wick applicator disposed within said jacket and extending outwardly of the upper end of said jacket, a vertically elongated slot in said jacket, means engaging said wick applicator through said slot for axially shifting same relative to said jacket, and means for supplying the liquid to said wick applicator for wetting the tip end thereof, whereby different contours of workpiece surfaces can be coated upon workpiece rotation.

2. The apparatus according to claim 1, wherein means are provided for adjusting the location of said jacket along said track means.

3. The apparatus according to claim 1, wherein said support member includes a plurality of track elements extending radially outwardly of said axis, a wick jacket being mounted on each said track element at different predetermined distances from said spindle for describing different predetermined paths, and a wick applicator being disposed within each said jacket.

4. The apparatus according to claim 1, wherein means are provided for tilting said jacket relative to said support member to accommodate different contours of workpiece surfaces to be coated.

5. The apparatus according to claim 1, wherein a cam element is mounted on said spindle for rotation therewith, and a cam follower roller is mounted on said support member for movement together with said jacket along said track element, and spring means biasing said jacket toward said spindle, whereby the liquid may be applied along a predetermined path corresponding to the shape of said cam.

* * * * *